US006812951B2

(12) United States Patent
Umeda

(10) Patent No.: US 6,812,951 B2
(45) Date of Patent: Nov. 2, 2004

(54) IMAGE RECORDING METHOD AND APPARATUS WITH DENSITY CONTROL

(75) Inventor: Toshikazu Umeda, Hachioji (JP)

(73) Assignee: Konica Corporation (JP)

( * ) Notice: Subject to any disclaimer, the term of this patent is extended or adjusted under 35 U.S.C. 154(b) by 50 days.

(21) Appl. No.: 10/283,168

(22) Filed: Oct. 29, 2002

(65) Prior Publication Data

US 2003/0095176 A1 May 22, 2003

(30) Foreign Application Priority Data

Nov. 22, 2001 (JP) ..... 2001-356925

(51) Int. Cl.[7] ..... B41J 2/47
(52) U.S. Cl. ..... 347/240; 347/254
(58) Field of Search ..... 347/131, 133, 347/240, 251, 253, 254, 236, 246; 355/37; 359/204; 430/363, 505

(56) References Cited

U.S. PATENT DOCUMENTS 4,619,892 A * 10/1986 Simpson et al. ..... 430/505
5,500,329 A * 3/1996 Kawai et al. ..... 430/363
5,995,195 A * 11/1999 Kodama et al. ..... 355/37
6,606,180 B2 * 8/2003 Harada ..... 359/204

FOREIGN PATENT DOCUMENTS

JP 292893 10/2000
JP 292897 10/2000

* cited by examiner

*Primary Examiner*—Hai Pham
(74) *Attorney, Agent, or Firm*—Muserlian, Lucas and Mercanti

(57) ABSTRACT

An image recording method includes: forming a latent image on a photothermographic imaging material by exposing a light beam from a light source thereto; and forming a visible image on the photothermographic imaging material on which the latent image is formed by thermally developing it. A wavelength characteristic of the light beam from the light source is selected on a basis of a spectral sensitivity characteristic of the photothermographic imaging material so that a first sensitivity variation of at least one of the thermally developed photothermographic imaging material and the exposed photothermographic imaging material which is before being thermally developed, the first sensitivity variation being caused by a temperature variation, and a second sensitivity variation of the photothermographic imaging material according to a wavelength variation of the light beam from the light source cause by the temperature variation are offset.

22 Claims, 6 Drawing Sheets

IMAGE RECORDING METHOD AND APPARATUS WITH DENSITY CONTROL

BACKGROUND OF THE INVENTION

1. Field of the Invention

The present invention relates to an image recording method and apparatus for obtaining a visible image by performing thermal development after recording an image on a photothermographic imaging material by irradiating a laser beam to the photothermographic imaging material.

2. Description of Related Art

An image recording apparatus for forming an image on a film by heating the film so as to thermally develop it after forming a latent image by exposing a laser beam to the film of thermally developable silver halide photosensitive material on the basis of an image signal has been known (for example, cf. Japanese Patent Laid-Open Publication No. 2000-292893, Japanese Patent Laid-Open Publication No. 2000-292897 by the applicant or the like, or the like). In such an image recording apparatus, since thermal development treatment is performed, the density of the outputted image varies when the temperature in the inside of the apparatus varies. Therefore, it is difficult to obtain the density stably. In general, the temperature in the apparatus changes for about several ° C. to 10° C. in accordance with the time course from power activation, change of environmental temperature, difference in number of sheets of the outputting images, or the like.

In order to stabilize the density by restraining the density variation of the outputted images that is caused by the temperature variation in the image recording apparatus in which thermal development treatment is performed, the following measures have been taken in earlier technology.

(1) Providing a density patch for controlling the density on the recording image beforehand, and measuring the density of the density patch portion after thermal development. Then, controlling the intensity of beam at the time of exposure so that the density will become a predetermined density at the time of outputting the image.

(2) Devising a ventilation system so that the temperature in the apparatus will be constant, and moreover, detecting the temperature in the apparatus and controlling the ventilation system.

(3) Controlling the intensity of beam irradiated to the film or the temperature of the thermal development drum on the basis of the detected temperature information in the apparatus.

The above-mentioned measures are attempted to restrain the density variation of the outputted image caused by the temperature variation. However, the control is complicated and the cost becomes high, so that it is difficult to obtain ability sufficient as density stability.

SUMMARY OF THE INVENTION

The present invention was made in view of the above-described problems in earlier technology. An object of the present invention is to provide an image recording method and apparatus that are capable of achieving density stability by restraining the density variation of the outputted image caused by a temperature variation.

In order to achieve the above-described object, according to an aspect of the present invention, the image recording method of the present invention comprises: forming a latent image on a photothermographic imaging material by exposing a light beam from a light source to the photothermographic imaging material; and forming a visible image on the photothermographic imaging material by thermally developing the photothermographic imaging material on which the latent image is formed; wherein a wavelength characteristic of the light beam from the light source is selected on a basis of a spectral sensitivity characteristic of the photothermographic imaging material so that a first sensitivity variation of at least one of the thermally developed photothermographic imaging material and the exposed photothermographic imaging material which is before being thermally developed, the first sensitivity variation being caused by a temperature variation, and a second sensitivity variation of the photothermographic imaging material according to a wavelength variation of the light beam from the light source caused by the temperature variation are offset.

According to the image recording method, the temperature of the light source varies while the sensitivity of the thermally developed photothermographic imaging material varies, according to the temperature variation. Thereby, the wavelength of the light beam exposed from the light source on the basis of an image signal varies, and the sensitivity of the photothermographic imaging material (the photothermographic imaging material in the forming of the latent image) varies. However, since the wavelength characteristic of the light beam is selected on the basis of the spectral sensitivity characteristic of the photothermographic imaging material, and the former sensitivity variation and the latter sensitivity variation are offset, the density variation of an outputted image caused by the temperature variation can be restrained and density stability can be achieved. Thus, in the image recording method according to the present invention, the variation in characteristic of development of the photothermographic imaging material according to the temperature and the spectral sensitivity characteristic of the photothermographic imaging material depending on the temperature characteristic of the wavelength of the light source are set so that both sensitivity variations will be offset. Thereby, the density variation of the outputted image caused by the temperature variation can be restrained effectively.

In the present specification, "offset" means that two opposite effects obtained from two different characteristics weaken the mutual effects to some extent, respectively. It is not required to make mutual effects into zero. Further, to "thermally develop" means to develop by heating the photothermographic imaging material on which the latent image is formed at a predetermined temperature for a predetermined time.

Further, according to a second aspect of the present invention, the image recording method of the present invention comprises: forming a latent image on a photothermographic imaging material by exposing a light beam from a light source to the photothermographic imaging material; and forming a visible image on the photothermographic imaging material by thermally developing the photothermographic imaging material on which the latent image is formed; wherein the light source has a temperature characteristic such that a peak of a wavelength of the light beam shifts to long wavelength side according to a temperature rise, and the light beam from the light source has the peak of the wavelength in a wavelength side longer than a peak of a spectral sensitivity of the photothermographic imaging material.

According to the image recording method, the sensitivity of the thermally developed photothermographic imaging material becomes large according to a temperature rise. On the other hand, the peak of wavelength of the light beam exposed from the light source on the basis of an image signal varies to the long wavelength side by the temperature rise of the light source according to the above-described temperature rise. Since the peak of the wavelength of the light beam is in the wavelength side longer than the peak of the spectral sensitivity of the photothermographic imaging material, the sensitivity of the photothermographic imaging material to the light beam varied to the long wavelength becomes small. Therefore, since the former sensitivity variation and the latter sensitivity variation of the thermally developable photosensitivity material are offset, the density variation of an outputted image caused by the temperature variation can be restrained, and density stability can be achieved.

Further, preferably, the photothermographic imaging material has a spectral sensitivity characteristic so that the spectral sensitivity of the photothermographic imaging material varies in a range of −0.5% to −3% to a variation of wavelength of 1 nm in a wavelength side longer than a peak of the spectral sensitivity. Thereby, the spectral sensitivity of the photothermographic imaging material may deteriorate moderately to the wavelength variation of the light source caused by the temperature variation.

Moreover, preferably, the above-mentioned image recording methods further comprise: measuring a density of a predetermined portion of the thermally developed photothermographic imaging material; and controlling at least one of the light source and the thermal development so that the measured density becomes a predetermined density. Further, the light source is preferably to be one of a semiconductor laser and a light emitting diode.

Further, according to a third aspect of the present invention, the image recording apparatus of the present invention comprises: an exposure portion having a light source, for forming a latent image on a photothermographic imaging material by exposing a light beam to the photothermographic imaging material from the light source; and a thermal development portion for forming a visible image on the photothermographic imaging material by thermally developing the photothermographic imaging material on which the latent image is formed; wherein a wavelength characteristic of the light beam from the light source is selected on a basis of a spectral sensitivity characteristic of the photothermographic imaging material so that a first sensitivity variation of at least one of the thermally developed photothermographic imaging material and the exposed photothermographic imaging material which is before being thermally developed, the first sensitivity variation being caused by a temperature variation in the apparatus, and a second sensitivity variation of the photothermographic imaging material according to a wavelength variation of the light beam from the light source caused by the temperature variation in the apparatus are offset.

According to the image recording apparatus, the temperature of the light source varies while the sensitivity of the photothermographic imaging material thermally developed in the thermal development portion varies, according to the temperature variation. Thereby, the wavelength of the light beam exposed from the light source on the basis of an image signal varies, and the sensitivity of the photothermographic imaging material (the photothermographic imaging material on which the latent image is formed) varies. However, since the wavelength characteristic of the light beam is selected on the basis of the spectral sensitivity characteristic of the photothermographic imaging material, and the former sensitivity variation and the latter sensitivity variation are offset, the density variation of an outputted image caused by the temperature variation can be restrained and density stability can be achieved. Thus, in the image recording apparatus according to the present invention, the variation in characteristic of development of the photothermographic imaging material according to the temperature and the spectral sensitivity characteristic of the photothermographic imaging material depending on the temperature characteristic of the wavelength of the light source are set so that both sensitivity variations will be offset. Thereby, the density variation of the outputted image caused by the temperature variation can be restrained effectively.

Further, according to a fourth aspect of the present invention, the image recording apparatus of the present invention comprises: an exposure portion having a light source, for forming a latent image on a photothermographic imaging material by exposing a light beam to the photothermographic imaging material from the light source; and a thermal development portion for forming a visible image on the photothermographic imaging material by thermally developing the photothermographic imaging material on which the latent image is formed; wherein the light source has a temperature characteristic such that a peak of a wavelength of the light beam shifts to long wavelength side according to a temperature rise in the apparatus, and the light beam from the light source has the peak of the wavelength in a wavelength side longer than a peak of a spectral sensitivity of the photothermographic imaging material.

According to the image recording apparatus, the sensitivity of the thermally developed photothermographic imaging material becomes large according to a temperature rise in the apparatus. On the other hand, the peak of wavelength of the light beam exposed from the light source on the basis of an image signal varies to the long wavelength side by the temperature rise of the light source according to the temperature rise in the apparatus. Since the peak of the wavelength of the light beam is in the wavelength side longer than the peak of the spectral sensitivity of the photothermographic imaging material, the sensitivity of the photothermographic imaging material to the light beam varied to the long wavelength becomes small. Therefore, since the former sensitivity variation and the latter sensitivity variation of the thermally developable photosensitivity material are offset, the density variation of the outputted image caused by the temperature variation can be restrained, and density stability can be achieved.

Further, the light source is preferable to be one of a semiconductor laser and a light emitting diode. Moreover, preferably, the photothermographic imaging material has a spectral sensitivity characteristic so that the spectral sensitivity of the photothermographic imaging material varies in a range of −0.5% to −3% to a variation of wavelength of 1 nm in a wavelength side longer than a peak of the spectral sensitivity.

Moreover, preferably, the above-mentioned image recording apparatuses further comprise: a densitometry portion for measuring a density of a predetermined portion of the photothermographic imaging material developed in the thermal development portion, wherein at least one of the exposure portion and the thermal development portion is controlled so that the density measured by the densitometry portion becomes a predetermined density. Thereby, the density variation of the outputted image caused by the temperature variation can be corrected and restrained in further high accuracy.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

PREFERRED EMBODIMENT OF THE INVENTION

Figure 1:
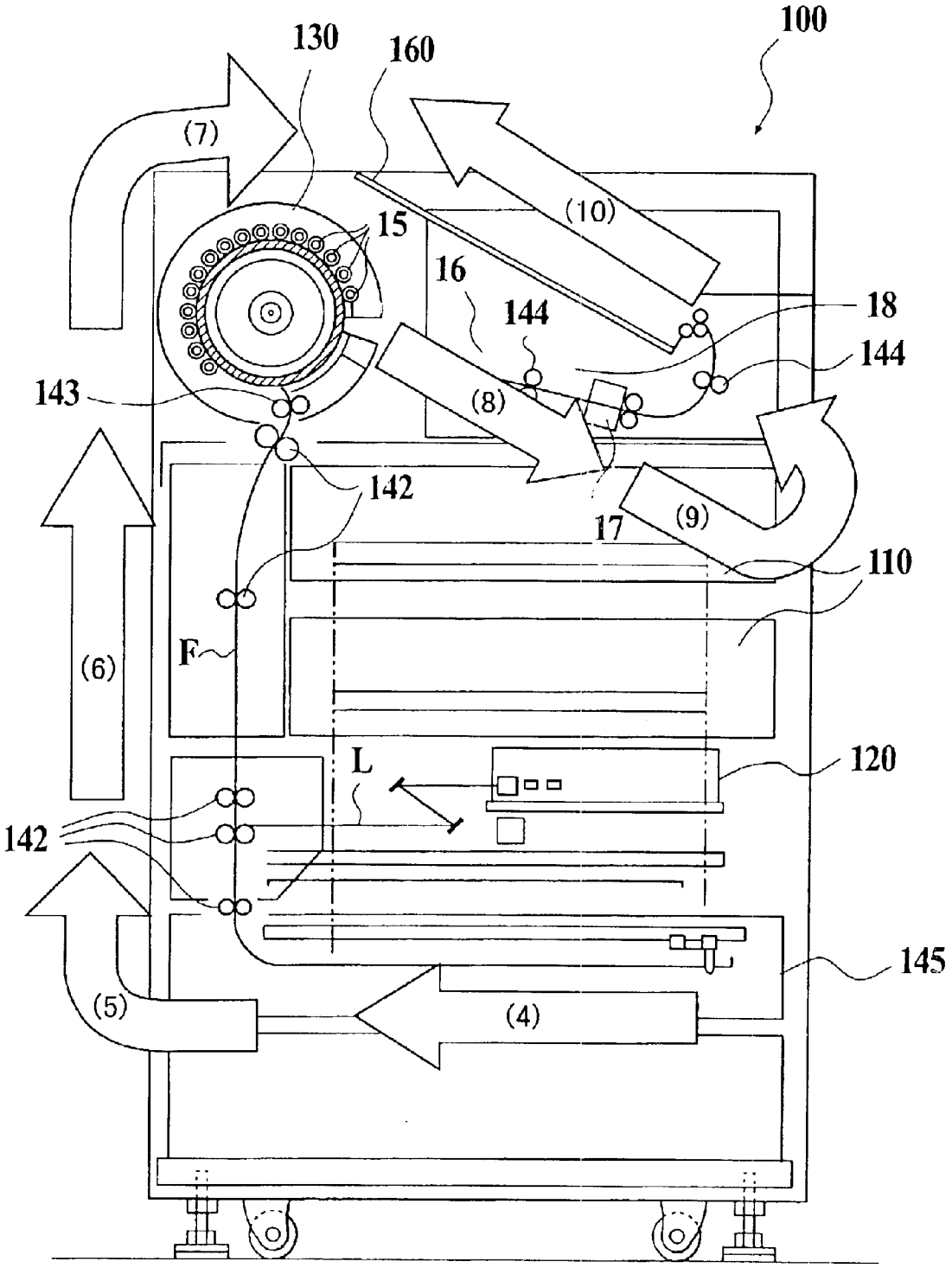
FIG. 1 is a front view showing a schematic structure of an image recording apparatus according to an embodiment of the present invention.

Hereinafter, an embodiment according to the present invention will be explained with reference to the drawings. FIG. 1 is a front view showing a schematic structure of an image recording apparatus 100 according to the embodiment of the present invention. As shown in FIG. 1, the image recording apparatus 100 comprises a feeding portion 110 for feeding photothermographic imaging films F (for example, medical imaging film DRYPRO SD-P made by Konica Corporation; hereinafter, it is called "film"), which are sheet-like photothermographic imaging materials, one by one, an exposure portion 120 for performing image recording (for forming a latent image) by exposing the fed film F, a thermal development portion 130 for thermally developing the exposed film F (the photothermographic imaging material in which the latent image is formed).

The feeding portion 110 is provided in upper and lower stages. The film F is contained in a case, and the whole case is housed in the feeding portion 110. The film F is ejected from the case by an ejecting device (not shown) in the feeding portion 110. The ejected film F is conveyed downwardly in FIG. 1, and the film F is conveyed to the horizontal direction in a transport direction changing portion 145, as shown by an arrow (4) in FIG. 1. Moreover, the film F is conveyed to upper perpendicular direction as shown by an arrow (5) in FIG. 1 by a plurality of conveying devices 142 made by roller pairs and the like. In this case, a laser beam L, which is a light beam, with a wavelength of 810 nm is irradiated to the film F from the exposure portion 120. A latent image is formed on the film F by the laser beam L modulated on the basis of an image signal.

Thereafter, the film F is conveyed further upwardly as shown by an arrow (6) in FIG. 1, and is carried to a thermal development drum 14 in the thermal development portion 130 by a feed roller pair 143. The thermal development drum 14 is heated by a built-in heating member, and is controlled at a constant temperature within a range of 100 to 140° C. In the thermal development drum 14, the film F is pressed against the outer circumferential surface of the thermal development drum 14 by a plurality of facing rollers 15. The thermal development drum 14 is rotated to the direction shown by an arrow (7) in FIG. 1 with the film F in a state that the film F is in close contact with the outer circumferential surface of the thermal development drum 14.

The thermal development drum 14 thermally develops the film F for 5 to 20 seconds by heating during the above-mentioned rotation. Then, the film F is separated from the thermal development drum 14 in the right side in FIG. 1, and is conveyed to the direction shown by an arrow (8) in FIG. 1 from the outlet portion 16 by a conveying device 144. Then, the film F is cooled by a cooling portion 18. Thereafter, the film F separated from the drum 14 is conveyed to the direction shown by arrows (9) and (10) in FIG. 1 by the conveying device 144, and is ejected onto an output tray 160 so as to be taken out from the upper portion of the image recording apparatus 100.

The latent image in the film F is formed to be a visible image by performing thermal development treatment to the film F on which the latent image is formed in the above-mentioned manner. The thermal development treatment is performed while the film F is in close contact with the thermal development drum 14. However, there is heat reserve remained in the film F after it is separated from the thermal development drum 14, and the atmospheric temperature in the vicinity of the thermal development drum 14 is also high. Therefore, the thermal development does not stop completely, and the development progresses slightly.

Here, the "thermal development" is performed while the film F is carried to the thermal development drum 14 in the thermal development portion 130 until it is separated from the thermal development drum 14. That is, in the step after the film F is separated from the thermal development drum 14, it does not say that the thermal development is performed.

Figure 2:
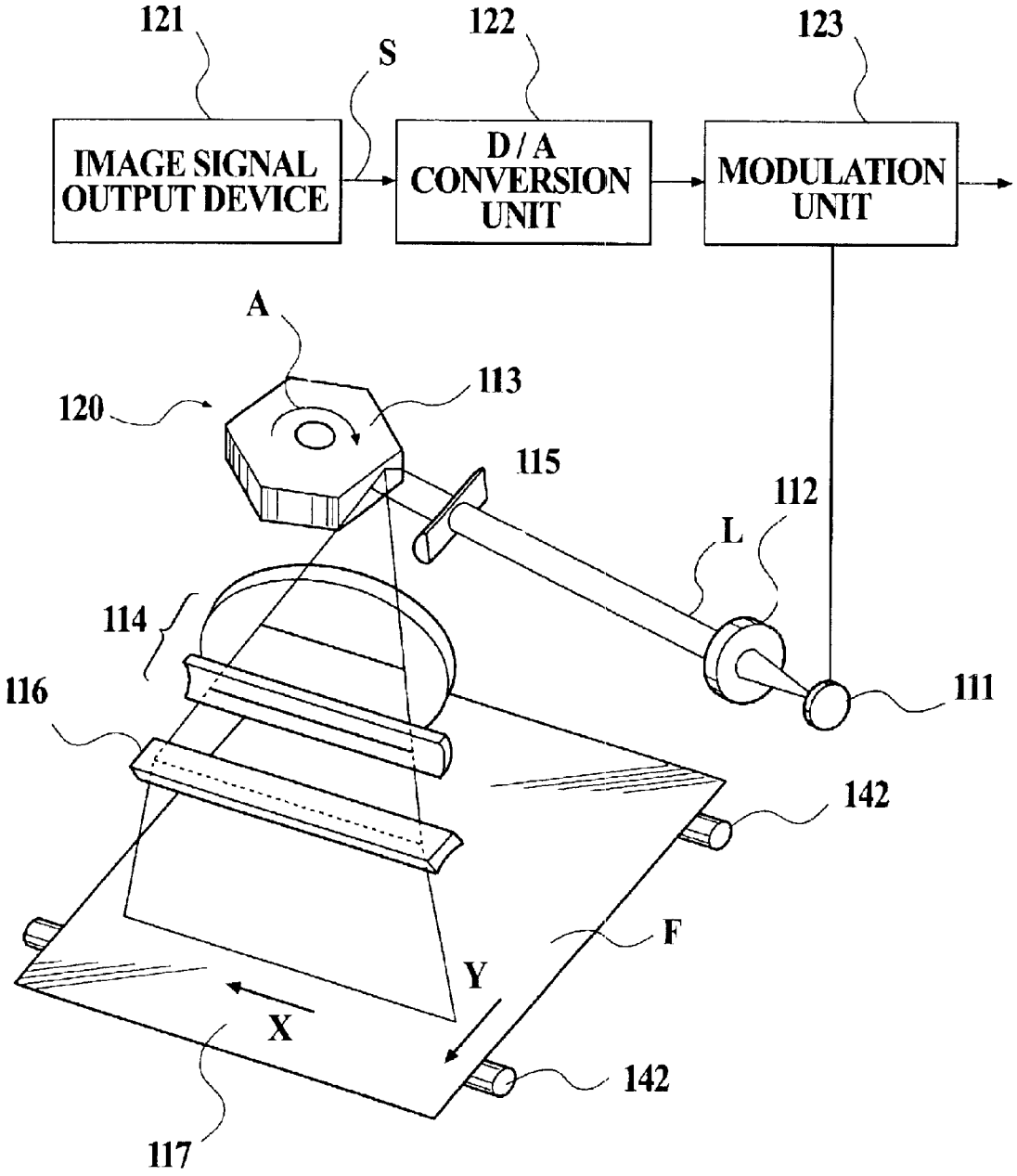
FIG. 2 is a view schematically showing an optical system and a control system of an exposure portion of the image recording apparatus in FIG. 1.

Next, the exposure portion 120 in the image recording apparatus 100 will be explained with reference to FIG. 2. FIG. 2 is a view schematically showing the optical system and the control system of the exposure portion 120 in the image recording apparatus 100 in FIG. 1.

As shown in FIG. 2, the exposure portion 120 deflects the laser beam L whose intensity is modulated on the basis of an image signal S, by a rotary polygonal mirror 113, to perform main scanning on the film F through an fθ lens 114. Moreover, the film F is moved relatively to the direction approximately perpendicular to the main scanning direction for the laser beam L, to perform sub-scanning. Thereby, the latent image is formed on the film F. Hereinafter, the exposure portion 120 and its control system will be further explained.

As shown in FIG. 2, the image signal S outputted from an image signal output device 121 is converted into an analog signal in a D/A conversion unit 122, and is inputted into a modulation unit 123, such as a modulation circuit or the like. A modulating signal is generated in the modulation unit 123 on the basis of the analog signal. A semiconductor laser 111 (for example, SDL-5421-G1 made by Uniphase Corporation), which is a light source, is driven by the modulating signal, and a laser beam L is irradiated from the semiconductor laser 111.

A light intensity monitoring signal from a photodetector (not shown) which receives the laser beam L irradiated from the semiconductor laser 111 is inputted into the modulation unit 123. Thereby, the modulation unit 123 controls the intensity of the laser beam L so as to be constant.

As shown in FIG. 2, the laser beam L irradiated from the semiconductor laser 111 passes through the lens 112. Thereafter, it is changed to an approximately parallel beam, and is converged only in up and down direction by a cylindrical lens 115. Then, the beam is inputted into the rotary polygonal mirror 113, which rotates in the arrow A direction in FIG. 2, as a line image which is long in the direction perpendicular to its driving axis. The rotary polygonal mirror 113 reflects and deflects the laser beam L to the main-scanning direction. The deflected laser beam L passes through the fθ lens 114, which includes a cylindrical lens. Thereafter, the beam is reflected in the mirror 116 provided so as to be extended in the main-scanning direction on the optical path. Then, the beam is main scanned repeatedly in the arrow X direction on a scan surface 117 of the film F which is conveyed (sub-scanned) in the arrow Y direction by the conveying device 142. Thereby, the laser beam L scans the scan surface 117 on the film F.

The cylindrical lens of the fθ lens 114 converges the incident laser beam L on the scan surface 117 only in the sub-scanning direction. With respect to the sub-scanning direction, it is arranged so that the reflecting surface of the rotary polygonal mirror 113 and the scan surface 117 may be conjugated. Further, the distance between the fθ lens 114 and the scan surface 117 of the film F is equal to the focus distance in the main-scanning direction of the whole fθ lens 114. Thus, the cylindrical lens 115 and the fθ lens 114, which includes the cylindrical lens, are disposed in the exposure portion 120. Since the laser beam L is once converged only in the sub-scanning direction on the rotary polygonal mirror 113, the scanning position of the laser beam L does not deviate to the sub-scanning direction on the scan surface 117 of the film F even though pyramidal error or axis deviation is caused in the rotary polygonal mirror 113. Therefore, equally pitched scanning lines can be formed.

As described above, image recording is performed in the exposure portion 120 by forming the latent image on the film F on the basis of the image signal S.

Figure 3:
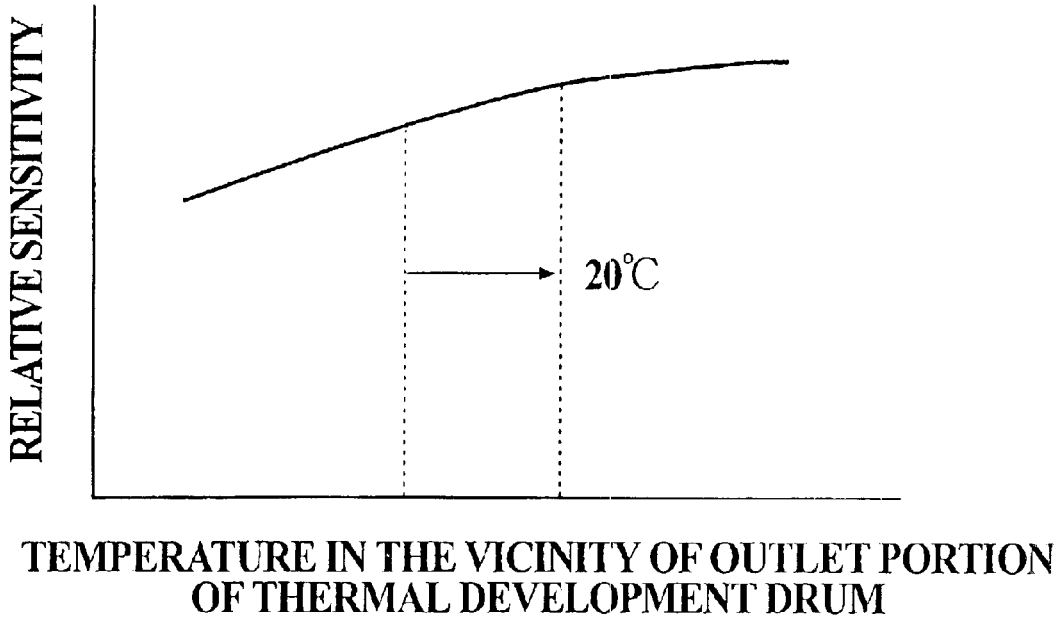
FIG. 3 is a sensitivity characteristic view of a film to temperature showing the relation between the temperature in the vicinity of an outlet portion of a thermal development drum of the image recording apparatus in FIG. 1 and the relative sensitivity of a thermally developable film separated from the thermal development drum.
Figure 4:
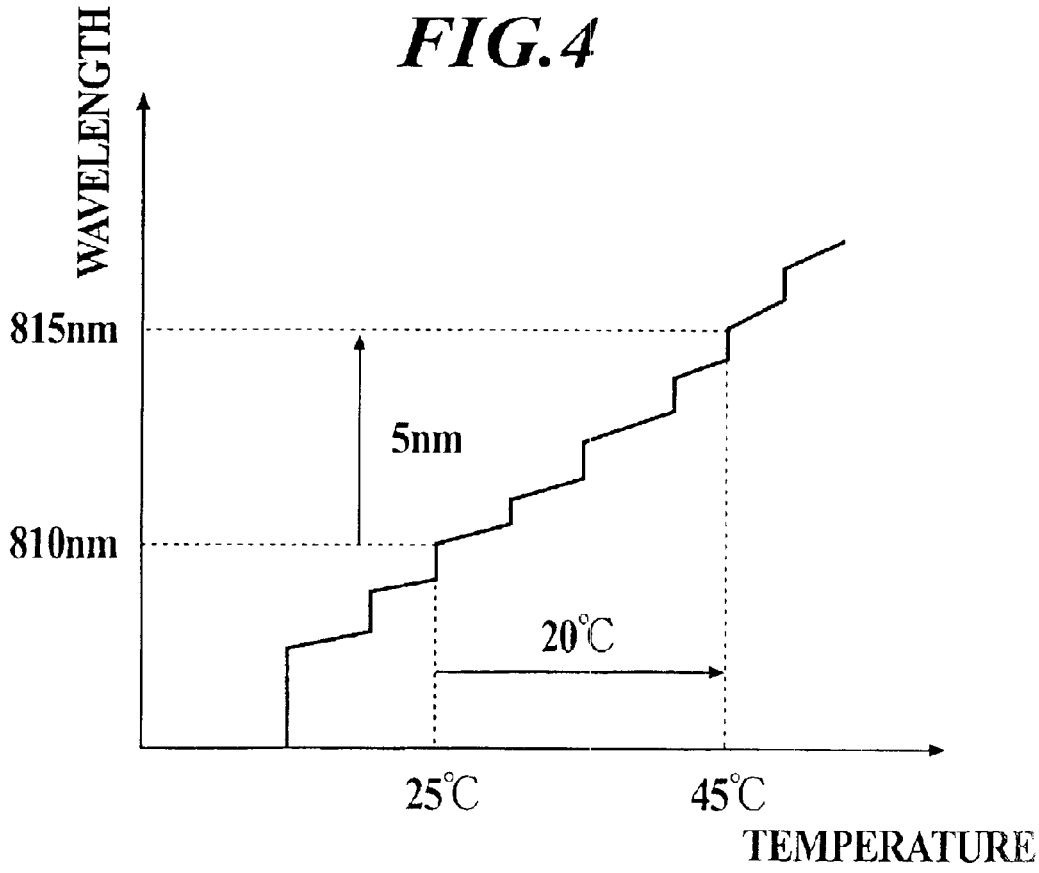
FIG. 4 is a temperature characteristic view of a wavelength of a light source schematically showing the relation between the oscillation wavelengths of a semiconductor laser in the optical system in FIG. 2 and the temperature.
Figure 5:
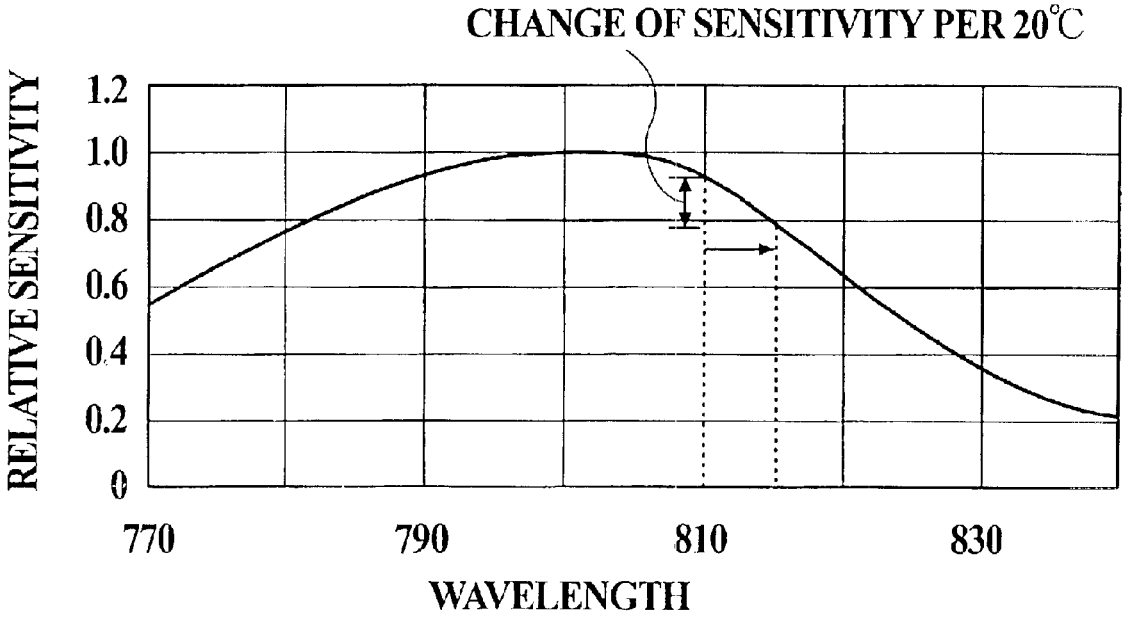
FIG. 5 is a spectral sensitivity characteristic view of the film showing the relation between a wavelength of a laser beam of the semiconductor laser in the embodiment and a relative sensitivity of the film.

Next, the control for stabilizing the density of the film in the embodiment will be explained with reference to FIGS. 3 to 5. FIG. 3 is a sensitive characteristic view showing the relation between the temperature in the vicinity of the outlet portion 16 of the thermal development drum 14 and the thermally developable film F separated from the thermal development drum 14 (thermally developed photothermographic imaging material). FIG. 4 is a temperature characteristic view of the wavelength of the light source schematically showing the relation between the oscillation wavelengths of the semiconductor laser 111 and the temperature. FIG. 5 is a spectral sensitivity characteristic view of the film F showing the relation between the wavelength of the laser beam L and the relative sensitivity of the film F.

There are various factors that affect the density variation of the film when the temperature in the image recording apparatus 100 changes. The following causes can be given as particularly remarkable factors.

(1) The relative sensitivity of the film F separated from the thermal development drum 14 rises as shown in FIG. 3 according to the promotion of development of the film F separated from the thermal development drum 14 by the temperature rise in periphery of the outlet portion 16 of the thermal development drum 14. That is, generally, the temperature of the thermal development drum 14 is controlled in a constant temperature (100° C. to 140° C.). However, the temperature in the vicinity of the outlet portion 16 of the thermal development drum 14 is not controlled, so that the development progresses even after the film F is separated from the thermal development drum 14.

(2) The wavelength of the semiconductor laser 111 as a light source varies (about+3 nm/10° C.) according to the temperature variation in the apparatus. Thereby, the film sensitivity varies according to the spectral sensitivity of the film F.

Therefore, in the embodiment, the oscillation wavelength of the semiconductor laser 111 as a light source in the exposure portion 120 in FIG. 2 or the peak of the wavelength of the laser beam L is set in the wavelength side longer than the peak of the spectral sensitivity of the film F. Thereby, even though the temperature in the apparatus rises, the variations in the (1) and (2) mentioned above are offset.

That is, the semiconductor laser 111 as a light source in the exposure portion 120 in FIG. 2 emits the laser beam L with a wavelength of 810 nm at the ordinary temperature (25° C.). However, it shows a temperature dependency as shown in FIG. 4. Therefore, it has a characteristic that the wavelength thereof becomes long at 2 to 3 nm/10° C. by the rise of the chip temperature of the semiconductor laser 111 in accordance with the rise of the temperature in the apparatus. Thereby, for example, when the temperature in the apparatus rises by 20° C. from the ordinary temperature (25° C.), the wavelength of the laser beam L from the semiconductor laser 111 changes to the long wavelength side and becomes long to about 815 nm.

Further, the film F has a spectral sensitivity characteristic as shown in FIG. 5. Its spectral sensitivity varies so as to deteriorate in a range of −0.5% to −3% to the change of wavelength of 1 nm in the wavelength side longer than the peak of the spectral sensitivity (800 nm in FIG. 5). Since the wavelength (810 nm) of the laser beam L of the semiconductor laser 111 at the ordinary temperature (25° C.) is in the wavelength side longer than the peak of the spectral sensitivity of the film F, for example, when the temperature in the apparatus rises by 20° C. and the laser beam L whose wavelength becomes long to about 815 nm is exposed, the film sensitivity deteriorates. In comparison with the film sensitivity when the laser beam L with the wavelength of 810 nm at the ordinary temperature is exposed, it deteriorates by 14%.

On the other hand, when the temperature in the apparatus rises by 20° C., the relative sensitivity of the film F separated from the thermal development drum 14 according to the temperature rise in periphery of the outlet portion 16 of the thermal development drum 14 becomes high by 10%, as shown in FIG. 3.

Therefore, when the temperature in the apparatus rises, for example, by 20° C., the relative sensitivity of the film F can be restrained to about 5% of deterioration of sensitivity as a whole. As mentioned above, even though the relative sensitivity of the film F rises by rise of the temperature in the apparatus, the relative sensitivity of the film F deteriorates in accordance with the variation of the wavelength of the laser beam L to the long wavelength side. Therefore, both variations can be offset.

As mentioned above, according to the image recording apparatus in FIGS. 1 and 2, the sensitivity variation of the film F, that is the density rise of the film, caused by the temperature rise in the vicinity of the outlet portion 16 of the thermal development drum 14 can be controlled and restrained effectively. Moreover, since it is not required to add novel control or parts, the cost of the apparatus does not rise, and it is advantageous. Further, no complicated control is required, so that the density variation can be controlled stably.

Further, the image recording apparatus 100 in FIG. 1 may comprise a densitometry portion 17 for measuring the density of the density patch portion for controlling the density of the film F while the film F separated from the thermal development drum 14 is conveyed from the outlet portion 16 by the conveying device 144. Then, the intensity of beam when the laser beam L is exposed may be controlled by controlling the modulation unit 123 in the exposure portion 120 in FIG. 2 or the heating temperature of the thermal development drum 14 may be controlled so that the density at the time of outputting the next image will become a predetermined density. In this case, the amount of the density variation which should be corrected can be reduced by applying the construction for restraining the density variation according to the embodiment. Therefore, correction of density in higher accuracy becomes possible, so that it is preferable.

Moreover, a ventilation system may be provided in the image recording apparatus 100 of the embodiment so that the temperature in the apparatus may be constant, and the ventilation system may be controlled so that the temperature in the apparatus may not rise. For example, the temperature of the cooling portion 18 when the film F separated from the thermal development drum 14 is conveyed from the outlet portion 16 by the conveying device 144 may be detected, and wind may be sent from the ventilation system into the apparatus when the temperature of the cooling portion 18 reaches not less than a predetermined temperature.

Further, the temperature in the apparatus may be detected at a predetermined portion, and the intensity of beam irradiated to the film F or the temperature of the thermal development drum 14 may be controlled on the basis of the detected temperature information in the apparatus.

Thus, when the methods for restraining density variation in the earlier technology are used together with the construction for restraining density variation according to the embodiment, the amount of density variation which should be corrected is reduced. Therefore, the density variation can be restrained in higher accuracy, and the density stability can be achieved.

Further, when the oscillation wavelength of the semiconductor laser 111 or the peak of the wavelength of the laser beam L is set in the region in which the inclination of the spectral sensitivity curve of the film F is comparatively small, for example, in the vicinity of 806 nm in FIG. 5 at the ordinary temperature, even though the temperature rise is the same and the range of wavelength variation of the laser beam L is the same, an extent of deterioration of the film sensitivity becomes small compared to the case of varying from 810 nm to 815 nm as mentioned above. The deterioration of the film sensitivity is approximately 9%. Therefore, the whole variation of film sensitivity can be further restrained, and the density variation of the film F can be restrained further.

As mentioned above, it is possible to correct the density in a higher accuracy by providing a density variation restraining mechanism comprising the densitometry portion 17 or the like, or by selecting the wavelength of the light beam at the time of exposure in accordance with the thermal development treatment or with the spectral sensitivity characteristic of the film F or the sensitivity characteristic of the film F to temperature.

Moreover, in the embodiment, the sensitivity characteristic of the film F to temperature (FIG. 3), the temperature characteristic of the wavelength of the semiconductor laser 111 (FIG. 4), and the spectral sensitivity characteristic of the film F (FIG. 5) are selected and set appropriately. Thereby, the both sensitivity variations, that is, the rise in sensitivity of the thermally developed film F as shown in FIG. 3 and the deterioration in film sensitivity as shown in FIGS. 4 and 5 that are caused by temperature rise can be offset effectively. Therefore, the density variation of the film F caused by temperature variation can be restrained.

Figure 6:
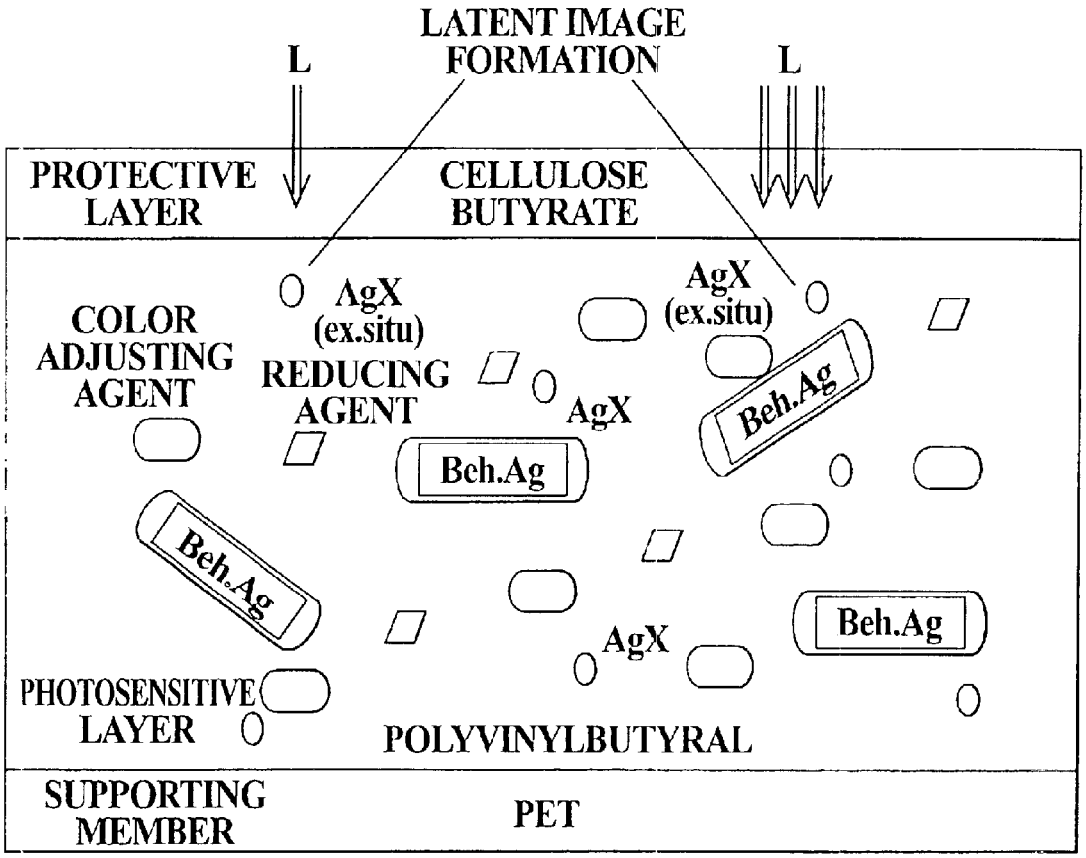
FIG. 6 is a schematic cross sectional view of a film showing chemical reaction in the film at the time of exposure.
Figure 7:
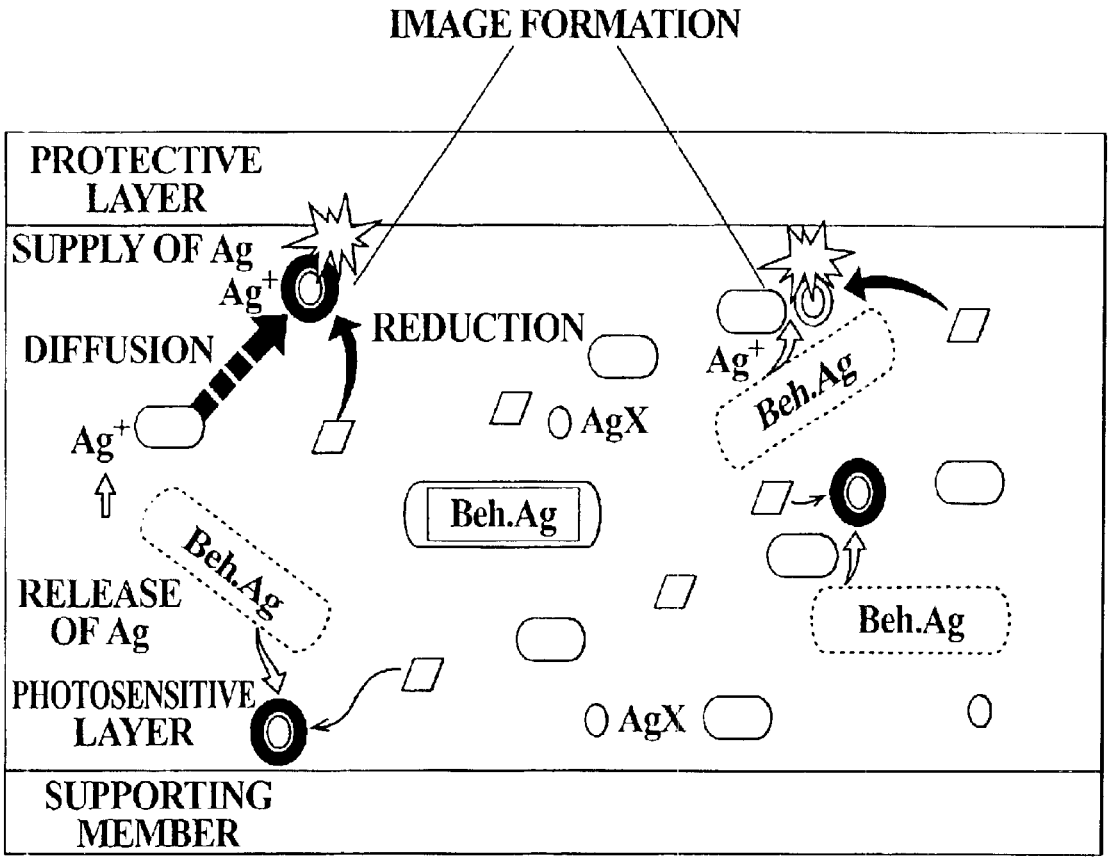
FIG. 7 is a schematic cross sectional view of the film showing chemical reaction in the film at the time of heating after the exposure.

Next, the above-mentioned film F will be explained. FIG. 6 is a cross sectional view of the film F, and is a view schematically showing the chemical reaction in the film F at the time of exposure. FIG. 7 is a cross sectional view schematically showing the chemical reaction in the film F at the time of heating. The film F comprises a supporting member (base layer) made from PET, a photosensitive layer whose main material is polyvinylbutyral, the photosensitivity layer being formed on the supporting member, and a protective layer made from cellulose butyrate, the protective layer being formed on the photosensitive layer. Silver halide particles, silver behenate (Beh. Ag), reducing agents, and color adjusting agents are included in the photosensitive layer.

At the time of exposure, when the laser beam L is irradiated to the film F from the exposure portion 120, the silver halide particles in the region where the laser beam L is irradiated sensitize the light, so that a latent image is formed, as shown in FIG. 6. On the other hand, when it reaches not less than the lowest thermal development temperature by heating the film F, the silver ions ($Ag^+$) are released from the silver behenate, and the behenic acid, which has released the silver ions, forms a complex with the color adjusting agents, as shown in FIG. 7. It seems that the silver ions are diffused thereafter, and that the reducing agents act by using the sensitized silver halide particles as a core, and that a latent image is formed by chemical reaction. Thus, the film F includes photosensitive silver halide particles, an organic silver salt, and a silver ion reducing agent. Then, the film F is thermally developed at a temperature (for example at 125° C.) not less than the lowest development temperature, which is not less than 100° C.

Preferably, the film F includes the organic silver salt not less than four times in terms of an amount of silver to the silver halide particles in the photosensitive layer.

Further, the average particle diameter of the silver halide particles (the arithmetic mean of the equivalent circle diameter of a mapping by an electron microscope) is preferable to be not more than 0.1 $\mu$m.

The silver halide particles may be any photosensitive silver halide, such as silver bromide, silver iodide, silver chloride, silver bromoiodide, silver chloroboromoiodide, silver chlorobromide or the like. The silver halide particles may be in any shape including cubic, orthorhombic system shape, planar-like, tetrahedron and the like.

The organic silver salts are silver salts of organic acids that are reducing sources of silver ions. Silver salts, such as long chain fatty acids (carbon atoms between 10 and 30, preferably, carbon atoms between 15 and 28), are preferable as such organic silver salts. Particularly, silver salts of organic compounds having carboxyl groups are preferable. Moreover, silver behenate and silver stearate are preferable. Further, silver salts of compounds having mercapto or thione group and the derivatives thereof, and silver salts of compounds having imino group are usable.

The reducing agent may be any material than can reduce a silver ion to a silver-metal, and preferably, it is an organic material. Phenidone, hydroquinone, and catecol can be mentioned as such a reducing agent, however, it is not limited to these. The phenol reducing agent out of these is preferable.

EXAMPLE

In the above-mentioned embodiment, an apparatus that fulfills all preferred conditions was installed in an environmental test lab. It was heated in a rate of 2° C./minute from the environmental temperature of 10° C. to 30° C. After the temperature has reached 30° C., it was maintained at a constant temperature for 10 minutes. Then, it was cooled in a rate of 2° C./minute. After the temperature has reached 10° C., it was maintained at a constant temperature for 10 minutes. While the above-described steps have been repeated, 125 sheets of films for dry image recording SD-P made by Konica Corporation were exposed and thermally developed by this apparatus in an interval of one sheet/minute. As a result, obviously, there was little variation in density in comparison with the variation in density according to the apparatus in the earlier technology.

The present invention is explained by the embodiment as described above. However, the present invention is not limited to this. Various modifications are possible within a range of technical idea of the present invention. For example, the light beam for irradiating to the film F is made to be laser beam L in FIG. 2. However, it may be a light beam from a light emitting diode (LED) or the like. Further, the light source is not limited to the semiconductor laser 111. It may be a light emitting diode (LED) or the like.

According to the image recording method and image recording apparatus of the present invention, the density variation of an outputted image caused by temperature variation can be restrained, and density stability can be achieved. Further, the density variation can be restrained in a higher accuracy, and density stability can be further achieved.

The entire disclosure of Japanese Patent Application No. 2001-356925 filed on Nov. 22, 2001 including specification, claims, drawings and summary are incorporated herein by reference in its entirety.

What is claimed is:

1. An image recording method comprising:

forming a latent image on a photothermographic imaging material by exposing a light beam from a light source to the photothermographic imaging material; and forming a visible image on the photothermographic imaging material by thermally developing the photothermographic imaging material on which the latent image is formed;

wherein a wavelength characteristic of the light beam from the light source is selected on a basis of a spectral sensitivity characteristic of the photothermographic imaging material so that a first sensitivity variation of at least one of the thermally developed photothermographic imaging material and the exposed photothermographic imaging material which is before being thermally developed, the first sensitivity variation being caused by a temperature variation, and a second sensitivity variation of the photothermographic imaging material according to a wavelength variation of the light beam from the light source caused by the temperature variation are offset.

2. The method of claim 1, wherein the photothermographic imaging material has the spectral sensitivity characteristic so that a spectral sensitivity of the photothermographic imaging material varies in a range of −0.5% to −3% to a variation of a wavelength of 1 nm in a wavelength side longer than a peak of the spectral sensitivity.

3. The method of claim 1, further comprising:

measuring a density of a predetermined portion of the thermally developed photothermographic imaging material; and controlling at least one of the light source and the thermal development so that the measured density becomes a predetermined density.

4. The method of claim 1, wherein the light source is one of a semiconductor laser and a light emitting diode.

5. The method of claim 1, wherein the photothermographic imaging material comprises a base layer, a photosensitive layer formed on the base layer, and a protective layer formed on the photosensitive layer.

6. The method of claim 1, wherein the first sensitivity variation occurs so as to make a sensitivity of the photothermographic imaging material increase when temperature rises, and the second sensitivity variation occurs so as to make the sensitivity of the photothermographic imaging material decrease when the temperature rises.

7. An image recording method comprising:

forming a latent image on a photothermographic imaging material by exposing a light beam from a light source to the photothermographic imaging material; and forming a visible image on the photothermographic imaging material by thermally developing the photothermographic imaging material on which the latent image is formed;

wherein the light source has a temperature characteristic such that a peak of a wavelength of the light beam shifts to long wavelength side according to a temperature rise, and the light beam from the light source has the peak of the wavelength in a wavelength side longer than a peak of a spectral sensitivity of the photothermographic imaging material.

8. The method of claim 7, wherein the photothermographic imaging material has a spectral sensitivity characteristic so that the spectral sensitivity of the photothermographic imaging material varies in a range of −0.5% to −3% to a variation of a wavelength of 1 nm in a wavelength side longer than a peak of the spectral sensitivity.

9. The method of claim 7, further comprising:

measuring a density of a predetermined portion of the thermally developed photothermographic imaging material; and controlling at least one of the light source and the thermal development so that the measured density becomes a predetermined density.

10. The method of claim 7, wherein the light source is one of a semiconductor laser and a light emitting diode.

11. The method of claim 7, wherein the photothermographic imaging material comprises a base layer, a photosensitive layer formed on the base layer, and a protective layer formed on the photosensitive layer.

12. An image recording apparatus comprising:

an exposure portion having a light source, for forming a latent image on a photothermographic imaging material by exposing a light beam to the photothermographic imaging material from the light source; and a thermal development portion for forming a visible image on the photothermographic imaging material by thermally developing the photothermographic imaging material on which the latent image is formed;

wherein a wavelength characteristic of the light beam from the light source is selected on a basis of a spectral sensitivity characteristic of the photothermographic imaging material so that a first sensitivity variation of at least one of the thermally developed photothermographic imaging material and the exposed photothermographic imaging material which is before being thermally developed, the first sensitivity variation being caused by a temperature variation in the apparatus, and a second sensitivity variation of the photothermographic imaging material according to a wavelength variation of the light beam from the light source caused by the temperature variation in the apparatus are offset.

13. The apparatus of claim 12, wherein the light source is one of a semiconductor laser and a light emitting diode.

14. The apparatus of claim 12, wherein the photothermographic imaging material has the spectral sensitivity characteristic so that a spectral sensitivity of the photothermographic imaging material varies in a range of –0.5% to –3% to a variation of a wavelength of 1 nm in a wavelength side longer than a peak of the spectral sensitivity.

15. The apparatus of claim 12, further comprising:

a densitometry portion for measuring a density of a predetermined portion of the photothermographic imaging material developed in the thermal development portion, wherein at least one of the exposure portion and the thermal development portion is controlled so that the density measured by the densitometry portion becomes a predetermined density.

16. The apparatus of claim 12, wherein the photothermographic imaging material comprises a base layer, a photosensitive layer formed on the base layer, and a protective layer formed on the photosensitive layer.

17. The apparatus of claim 12, wherein the first sensitivity variation occurs so as to make a sensitivity of the photothermographic imaging material increase when temperature rises, and the second sensitivity variation occurs so as to make the sensitivity of the photothermographic imaging material decrease when the temperature rises.

18. An image recording apparatus comprising:

an exposure portion having a light source, for forming a latent image on a photothermographic imaging material by exposing a light beam to the photothermographic imaging material from the light source; and a thermal development portion for forming a visible image on the photothermographic imaging material by thermally developing the photothermographic imaging material on which the latent image is formed;

wherein the light source has a temperature characteristic such that a peak of a wavelength of the light beam shifts to long wavelength side according to a temperature rise in the apparatus, and the light beam from the light source has the peak of the wavelength in a wavelength side longer than a peak of a spectral sensitivity of the photothermographic imaging material.

19. The apparatus of claim 18, wherein the light source is one of a semiconductor laser and a light emitting diode.

20. The apparatus of claim 18, wherein the photothermographic imaging material has a spectral sensitivity characteristic so that the spectral sensitivity of the photothermographic imaging material varies in a range of –0.5% to –3% to a variation of a wavelength of 1 nm in a wavelength side longer than a peak of the spectral sensitivity.

21. The apparatus of claim 18, further comprising:

a densitometry portion for measuring a density of a predetermined portion of the photothermographic imaging material developed in the thermal development portion, wherein at least one of the exposure portion and the thermal development portion is controlled so that the density measured by the densitometry portion becomes a predetermined density.

22. The apparatus of claim 18, wherein the photothermographic imaging material comprises a base layer, a photosensitive layer formed on the base layer, and a protective layer formed on the photosensitive layer.

* * * * *